US011805900B2

(12) United States Patent
Bertschi

(10) Patent No.: US 11,805,900 B2
(45) Date of Patent: Nov. 7, 2023

(54) VACUUM DRAWER DEVICE FOR STORING GROCERIES

(71) Applicant: Julius Blum GmbH, Hoechst (AT)

(72) Inventor: Daniel Bertschi, Gelfingen (CH)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 17/834,490

(22) Filed: Jun. 7, 2022

(65) Prior Publication Data

US 2022/0295988 A1 Sep. 22, 2022

Related U.S. Application Data

(63) Continuation of application No. PCT/EP2020/084939, filed on Dec. 7, 2020.

(30) Foreign Application Priority Data

Dec. 9, 2019 (CH) ..... 01568/19 (CH)

(51) Int. Cl.
*A47B 88/919* (2017.01)
*A47B 88/457* (2017.01)
*A47B 88/969* (2017.01)

(52) U.S. Cl.
CPC ..... *A47B 88/919* (2017.01); *A47B 88/457* (2017.01); *A47B 88/969* (2017.01);
(Continued)

(58) Field of Classification Search
CPC ... A47B 88/919; A47B 88/969; A47B 88/994; A47B 88/457; A47B 88/0414;
(Continued)

(56) References Cited

U.S. PATENT DOCUMENTS 5,157,940 A * 10/1992 Bertu ..... F25D 17/042 62/268
6,090,422 A * 7/2000 Taragan ..... F25D 17/042 62/169

(Continued)

FOREIGN PATENT DOCUMENTS

CH 713233 A2 * 6/2018 ..... A47B 77/16
CN 1910417 2/2007

(Continued)

OTHER PUBLICATIONS

Translation DE202017006169U1, 4 pages (Year: 2018).*

(Continued)

*Primary Examiner* — Andrew M Roersma
(74) *Attorney, Agent, or Firm* — Wenderoth, Lind & Ponack, L.L.P.

(57) ABSTRACT

A vacuum drawer device includes a drawer movable linearly in a drawer movement direction and having a drawer interior to be closed by an air-tight cover in a controlled manner by an electric lift. The cover thereby runs perpendicularly to the drawer movement direction in a lifting movement along a lifting direction. The cover has an air channel leading into the cover interior, and operatively connected to electric evacuation element such that when the cover is in place, air can be pumped out of the drawer interior through the air channel. A seal lining is arranged on the drawer walls of the drawer on the cover side to run over the entire inner periphery of the drawer such that the cover rests on the seal lining when the vacuum drawer device or the drawer is in a closed position to allow evacuation of the drawer interior.

7 Claims, 4 Drawing Sheets

(52) U.S. Cl.
CPC ..... *A47B 2088/976* (2017.01); *A47B 2210/06* (2013.01); *A47B 2210/08* (2013.01)

(58) Field of Classification Search
CPC ..... A47B 2088/0011; A47B 2088/976; A47B 2088/205; A47B 77/16; A47B 2210/06; A47B 2210/08; A47B 2210/0091
See application file for complete search history.

(56) References Cited

U.S. PATENT DOCUMENTS

| | | | | |
|---|---|---|---|---|
| 6,357,844 | B1 | 3/2002 | Müterthies et al. | |
| 11,530,870 | B2 * | 12/2022 | Bertschi | A47B 88/919 |
| 2007/0234754 | A1 | 10/2007 | Pimputkar et al. | |
| 2017/0307285 | A1 * | 10/2017 | Cizik | F25D 25/025 |
| 2018/0356148 | A1 * | 12/2018 | Fei | F25D 25/021 |
| 2020/0390239 | A1 * | 12/2020 | Wada | F25D 25/025 |
| 2021/0123667 | A1 | 4/2021 | Bertschi | |

FOREIGN PATENT DOCUMENTS

| | | |
|---|---|---|
| CN | 207936610 | 10/2018 |
| DE | 20 2017 006 169 | 2/2018 |
| EP | 0 440 296 | 8/1991 |
| WO | 2019/141574 | 7/2019 |

OTHER PUBLICATIONS

Translation WO2019141574A1, 21 pages (Year: 2019).*
International Search Report dated Mar. 3, 2021 in International (PCT) Application No. PCT/EP2020/084939.

* cited by examiner prior art FIG. 2

VACUUM DRAWER DEVICE FOR STORING GROCERIES

BACKGROUND OF THE INVENTION

The present invention relates to a vacuum drawer device comprising a drawer which can be moved linearly into a sliding movement direction and which has at least one drawer interior that can be closed by means of a cover designed in an airtight fashion by a lifting movement in a lifting direction extending perpendicularly to the sliding movement direction controlled by means of electric lifting means, wherein the cover has at least one air channel leading into the cover interior, wherein the air channel is operatively connected with electric evacuation means in such way that when the cover is in place, air can be pumped out from the at least one drawer interior through the at least one air channel.

Recently, storing food is supported by vacuum drawer devices, especially in private homes, which will make a few fridges unnecessary.

In DE202017006169 a vacuum drawer device comprising a drawer and a cover was disclosed for the first time in general, wherein a negative pressure could be produced in a drawer interior by means of a pump. The vacuum drawer device comprises a drawer with walls and a drawer interior R, wherein the drawer is operatively connected with a cover and is mounted within a drawer carcass such that it can be moved linearly. However, more details regarding the drawer, the cover, lifting means and evacuation means are mostly left undecided in DE202017006169.

As known from the prior art of WO2019/141574, a conventional vacuum drawer device in FIG. 1 is overall referred to as 0. In that case, the vacuum drawer device 0 comprises a drawer 3 (drawn in broken lines), and a cover 2. The drawer 3 can be operatively connected with the cover 2 and is mounted within a drawer carcass 9 such that it can be moved linearly. The drawer carcass 9 forms the outer casing in which the cover 2 and the drawer 3 are movably mounted in a protective manner. The drawer 3 comprises walls and a drawer interior R and is mounted in a linear sliding movement direction S such that it can be moved open and shut and designed such that it can be evacuated. According to the prior art, the drawer 3 is mounted in a drawer pull-out 31' such that it can be moved linearly so that the drawer 3 can be moved into an opened position and into a closed position. The drawer interior R that can be evacuated is designed by a plurality of containers 14, wherein the containers 14 are positionally arranged within the drawer 3 and each are of the same height but have different sizes. Preferably, the containers 14 are designed as GN Containers, the interiors of which can form the entire drawer interior R that can be closed and evacuated by means of the cover 2. The containers 14 are mounted in the drawer 3 and can be moved with the drawer 3 but they can also be removed.

The key element for evacuating the drawer interior R is the cover 2 which is arranged movably within the drawer carcass 9 and which is designed in an airtight fashion and which is mounted in a lifting direction H extending perpendicularly to the sliding movement direction S such that it can be lowered onto the drawer 3. At or in the cover 2 and within the drawer carcass 9, there are lifting means 7 arranged to keep the cover 2 movable within the drawer carcass 9 in the lifting direction H. With a cover side facing the drawer 3, the cover 2 can be put on the edges of the containers 14 through which the drawer interior R is closeable. The cover 2 is mounted so as to be movable relative to the drawer carcass 9 and to the drawer 3. Closing only takes place when the drawer 3 is in a closed position, when the drawer is in an opened position as according to FIG. 1, the cover 2 releases the drawer 3 entirely.

In this case, as lifting means 7 at the cover 2, several servo motors 7 which are operatively connected with lifting means are fixed within the drawer carcass 9. Rotatable servo discs 71' are each kept by a screw with a bearing bush 72' within the carcass 9 in such way that the cover 2 can be lifted in a manner controlled oppositely from the drawer 3 or, respectively, the containers 14 and is arranged onto them such that it can be lowered. This way, the lifting movement of the cover 2 in the lifting direction H extending perpendicularly to the sliding movement direction S of the drawer 3 is created. The containers 14 within the drawer 3 of the vacuum drawer device 0, unlike conventional drawers, can be closed off at the top if the user manually closes the drawer 3 and the cover 2 in the closed position of the drawer 3 lowers itself onto the containers 14 and from the top closes them off in an airtight fashion. At the front side of the cover 2, there are attached a closed-position sensor 6, an operating switch/on and off switch 15 and a proximity sensor 18.

As shown in FIG. 2, the containers 14 are within the drawer carcass 9 during the closed position of the drawer 3, wherein in this situation the cover 2 rests on the containers 14 and by this closes the container interiors R off at the top in an airtight fashion.

The cover 2 is shaped in such way that evacuation means in the form of a pump 1, a pressure sensor 16 and a valve 4 are fixed in at least one recess A integrated in the cover 2. In that case, also integrated in the cover 2 is a controller 8 to automize evacuation means and lifting means. However, the controller 8 can also be fixed at the drawer carcass 9, outside of the cover 2. The shaped cover 2 forms a frame 17 for evacuation means. The cover 2 by way of example comprises here the shaping or, respectively, the frame 17 and a foam layer 22'. The cover 2 can however also be made out of one material in one piece. An airtight membrane 21' is arranged on the bottom side facing the containers 14. The container interior R can be closed airtight by the airtight membrane which is put onto the opening of the drawer 3 or, respectively, onto the openings of the container 14 by means of the cover 2. The airtight membrane 21' has one air inlet opening 23' for each container interior R. This air inlet opening 23' either directly leads to an air channel 11' or indirectly leads to an air channel 11' through the foam layer 22'. The air channel 11' at least partially crosses the cover 2 and leads out of the cover 2. The air channel 11' is connected to at least one air inlet opening 23' such that air can be led out of the cover 2 from the air inlet opening 23' through the air channel 11'.

In order to take air out through the air channel 11', the air channel 11' is connected to the cover interior or, respectively, to the recess A, in which the evacuation means are arranged. When the cover 2 is put onto the drawer 3 or, respectively, the containers 14, air is pumped out of the at least one drawer interior R through the air channel 11' controlled by the controller 8. By integration of the components, the cover 2 has a very compact configuration and only control cables 11 run through the cover 2 or, respectively, the foam layer 22' and one cable runs from the cover 2 into one power supply unit.

On a front panel 13 that closes off the drawer 3 in the opening direction, there is a handle 12 on the outside and on the front side of the cover 2 directed to the handle 12, there is a proximity sensor 18 and the closed position sensor 6.

The required power is supplied to the cover 2 or, respectively, to the devices in the drawer carcass 9 to control the vacuum in the container interior R, by connecting the cover 2 to an electric cable which in turn is connected to the power supply unit.

The controller 8 by means of the proximity sensor 18 is able to recognize whether the drawer 3 is open or closed. The proximity sensor 18 is connected to the controller 8 via the control cable 11. Furthermore, by means of the pressure sensor 16, the controller 8 monitors the internal pressure in at least one container interior R of the drawer 3. In addition, the controller 8 handles the regulation of the vacuum pump 1 and the solenoid valve 4. By way of an air hose or, respectively, an air channel 11' connected to the vacuum pump 1, air that has been pumped from the drawer 3 is released to the environment, which has been marked with an broken-line arrow in FIG. 2.

In WO2019/141574 described above, the drawer interior is designed in such a way that a plurality of containers is arranged in an organized position within the drawer, and the containers always have the same height and also, for example, a peripheral edge in a flange-like manner. Such types of containers are known and distributed by the name Gastronorm (GN) Containers. The interiors of the containers form the entire drawer interior R and each individual container interior is closed with the cover and entirely evacuated. However, it is often the case that users would like to be independent from the container type, the number of inserted containers and also from the positioning of the containers, but still they would like to achieve the evacuation. With the way just described, that was not possible.

SUMMARY OF THE INVENTION

The present invention aims to create a vacuum drawer device that comprises a drawer, a cover, lifting means and evacuation means and that can be automatically evacuated and ventilated, wherein containers of any form, not standardized, also containers of different sizes and in different numbers can be inserted such that the respective container interiors can be evacuated.

Furthermore, it should be possible to achieve different negative pressures in individual container interiors, wherein only one cover is used.

Variations of feature combinations and/or minor adaptions of the invention can be found in the detailed description, are shown in the Figures.

BRIEF DESCRIPTION OF THE DRAWINGS

In the following, the invention will be described in detail in connection with the accompanying drawings, in which.

DETAILED DESCRIPTION OF THE INVENTION

Figure 1:
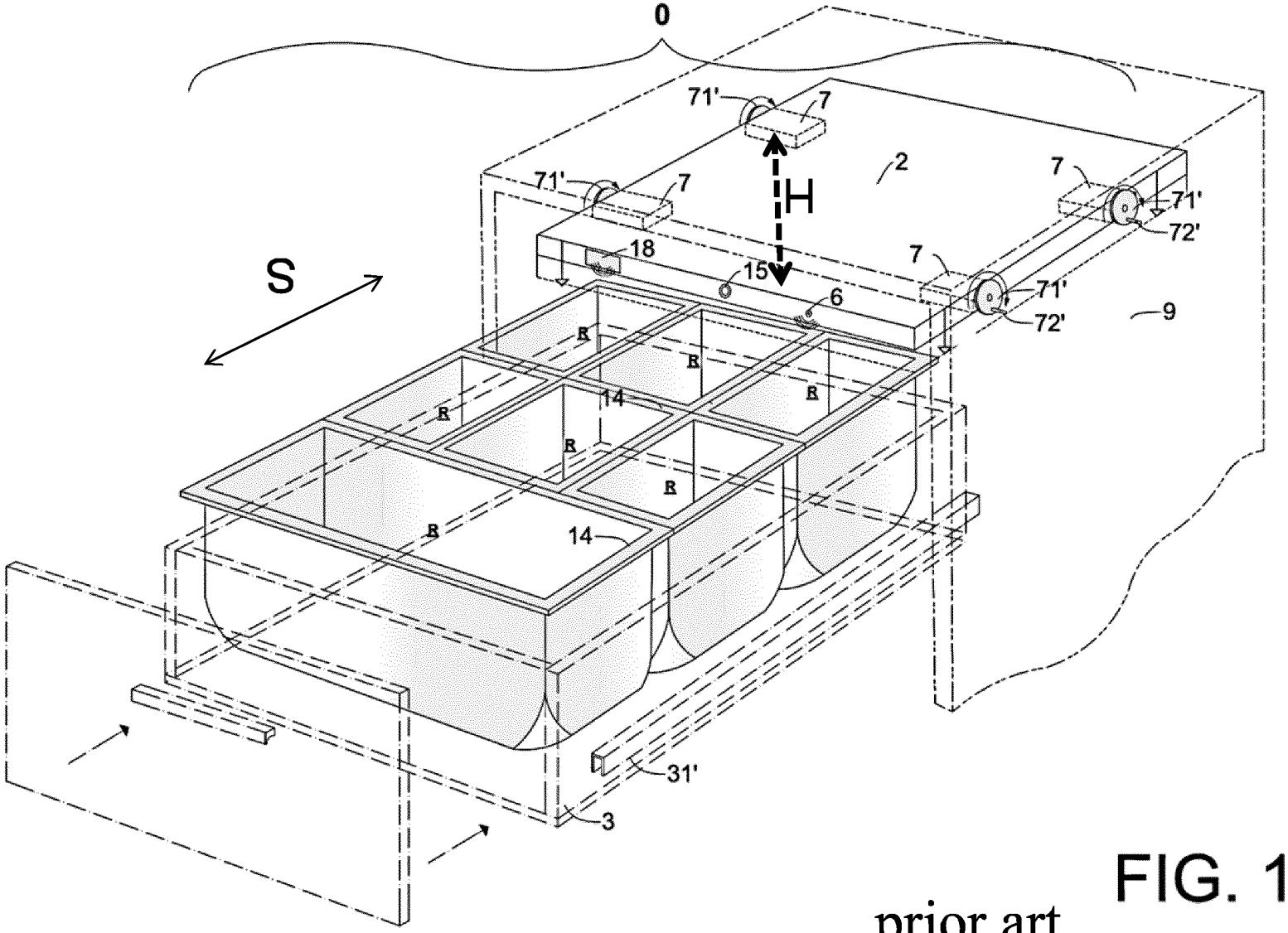
FIG. 1 prior art
FIG. 1 is a perspective view of a vacuum drawer device known from the state of the art in a drawer carcass with the drawer being open.
Figure 2:
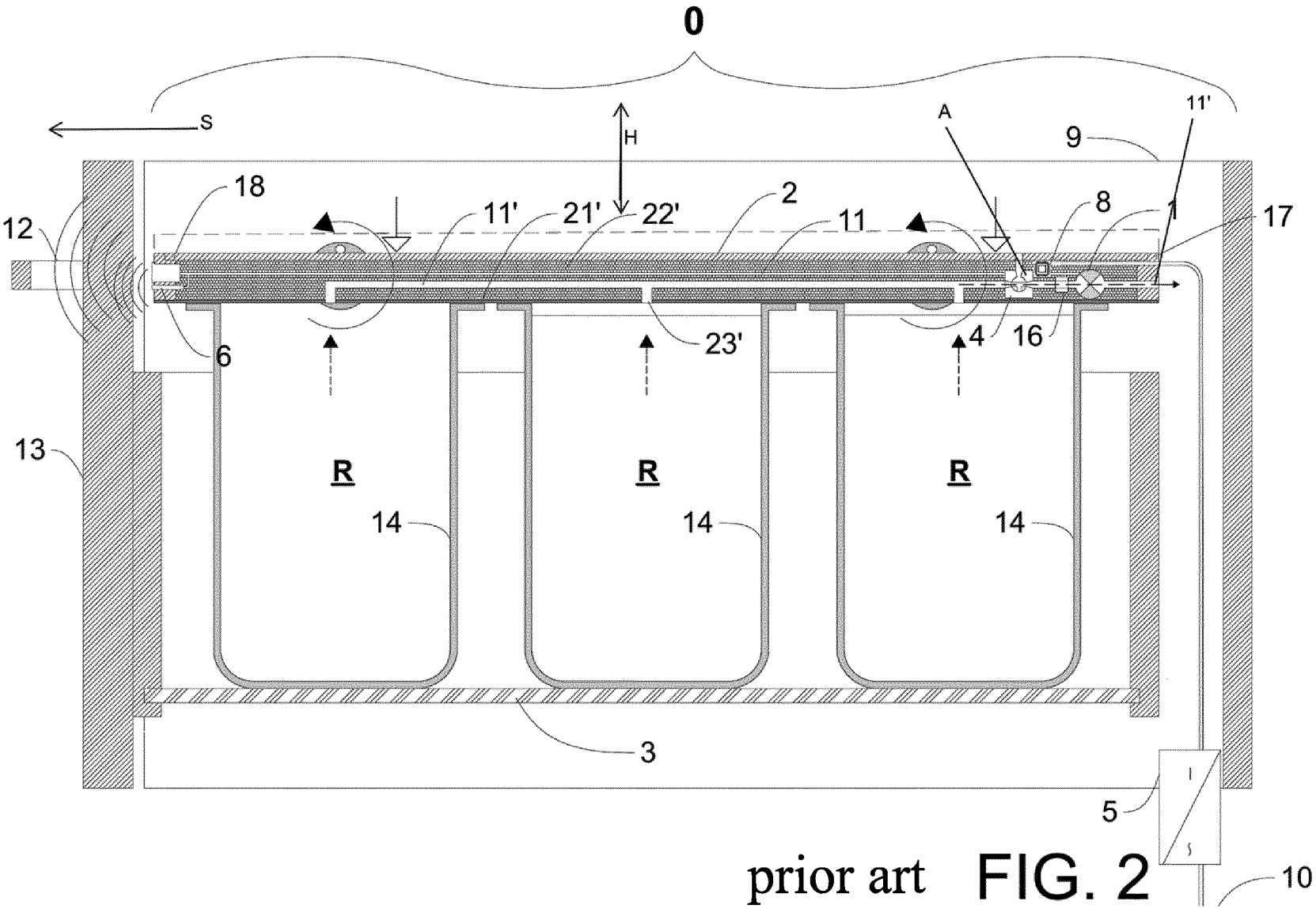
FIG. 2 is a partial schematic longitudinal section view through a vacuum drawer device of FIG. 1 in a drawer carcass with the vacuum drawer device in a closed state.
Figure 3:
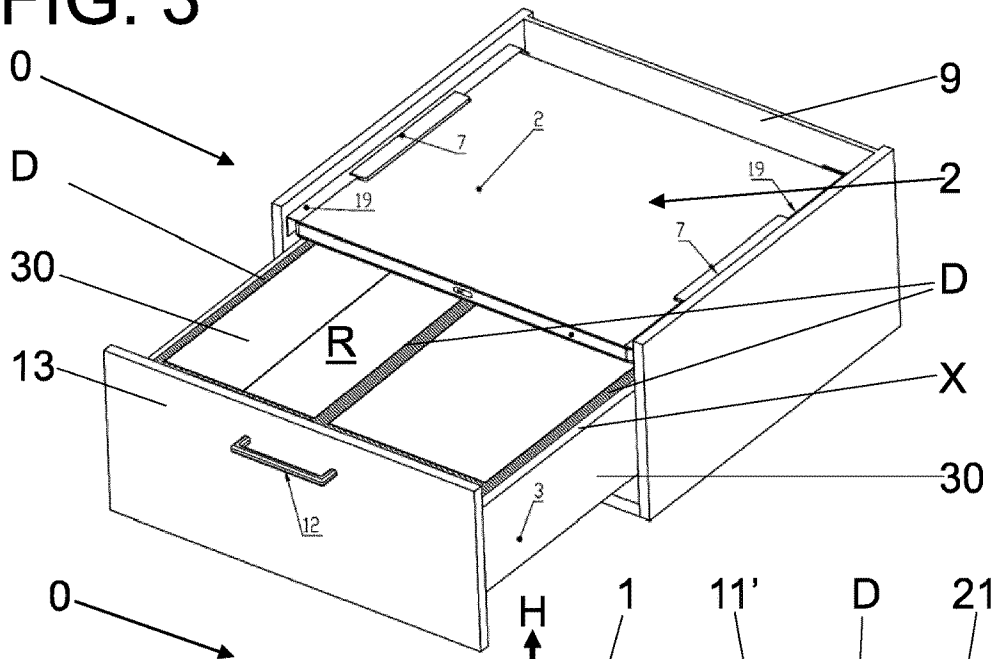
FIG. 3 is a perspective view of a vacuum drawer device with a drawer further developed.

The present invention relates to the following further development based on the vacuum drawer device 0 of the prior art described above. In particular, as shown in FIGS. 3-5*b*, the vacuum drawer device 0 comprises a drawer 3 that can be moved linearly in a sliding movement direction S and having at least one drawer interior R which can be closed by a cover 2 designed in an airtight fashion in a lifting movement into a lifting direction H extending perpendicularly to the sliding movement direction S controlled by an electric lifting means (electric lift) 7. The cover 2 has at least one air channel 11' leading into the cover interior, and the air channel 11' is operatively connected with electric evacuation means such that when putting the cover 2 onto the drawer 3, air can be automatically pumped out of the at least one drawer interior through the at least one air channel 11'. The cover 2 or, respectively, the lifting means (lift) 7 in that case is fixed at the drawer carcass 9 by the mounting angle 19. Most of the components have been adopted from the conventional vacuum drawer device 0 according to FIGS. 1 and 2, but the drawer 3 of the present invention has been further developed such that food can be stored in the drawer interior R in an evacuated manner independent of the type of container.

The cover 2 and support means at the drawer 3 are designed such that the cover 2 can be indirectly put onto the drawer. For that, one seal fitting D is arranged on the cover side along the drawer inside walls 30 at the drawer 3. The seal fitting D or the plurality of seal fittings D that are designed in an airtight manner and that preferably comprise metal angles are positioned, glued or screwed circumferentially along the entire inner periphery. Accordingly, that at least one seal fitting D can be designated as laterally extending.

When the cover 2 has been brought into the closed position by the lifting means (lift) 7, the cover 2 rests on the seal fittings D and an evacuation of the underlying drawer interior R can be achieved. In addition to the circumferential seal fittings D that are arranged at the same height as the drawer edge X, seal fittings D crossing the drawer periphery can also be arranged. Those seal fittings D are clamped between two opposing drawer walls 30 at the side of the drawer 3 directed to the cover 2. A seal fitting D can be clamped also between directly adjacent drawer walls 30.

The empty drawer interior R can be filled with different containers full of food, wherein the sizes of the containers should be smaller than the gap between the seal fittings D. As the cover 2 rests sealingly on the seal fittings D, it is not necessary for the containers 14 to have flanges or minimum sizes.

Figure 4:
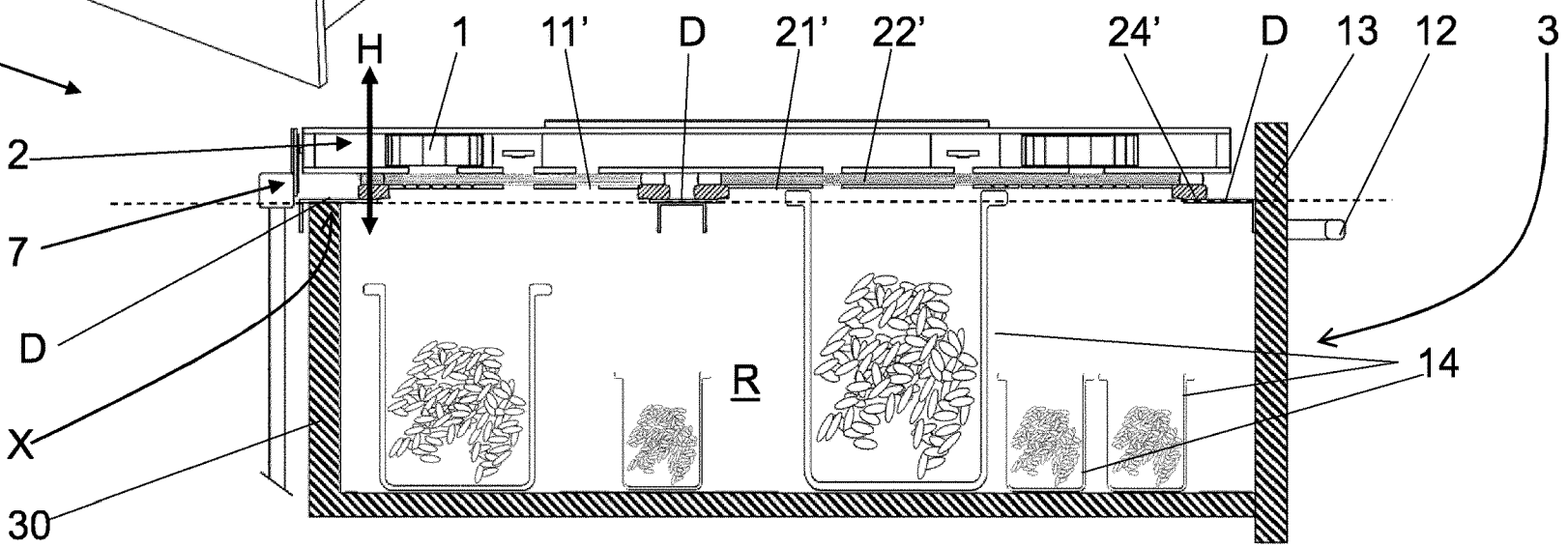
FIG. 4 is a sectional drawing of the vacuum drawer device according to FIG. 3 in a closed position of the drawer.

As can be seen in FIG. 4, the seal fittings D are circumferentially arranged to be flush with the drawer edge X extending circumferentially at the drawer walls 30 of the drawer 3 and are arranged between at least two adjacent drawer edges X. In that case, the front panel 13 is designed as extendable drawer wall 30 but the seal fitting D is arranged at the height of the surrounding drawer edges X, which is not an issue if the cover 2 correspondingly does not project over the front panel 13.

At the cover 2, at the side directed to the drawer interior R, there are arranged seals 24' that are operatively connected with the seal fittings D when the cover 2 is in the closed position (that is to say, moved in the lifting direction H into the direction of the drawer interior R). As seals 24', single-layered or multi-layered plastic sheets can be used through which an airtight sealing can be achieved.

However, seal fittings D that extend distanced from the drawer edge X and projecting from the drawer interior R can also be arranged at the drawer walls 30. In order to achieve an airtight sealing, the airtight seal fittings D should be configured as angles, the one leg of which leads perpendicularly out of the drawer 3 and the other leg of which serves as support for the cover 2 or, respectively, the sealing means 24'.

Figure 5A:
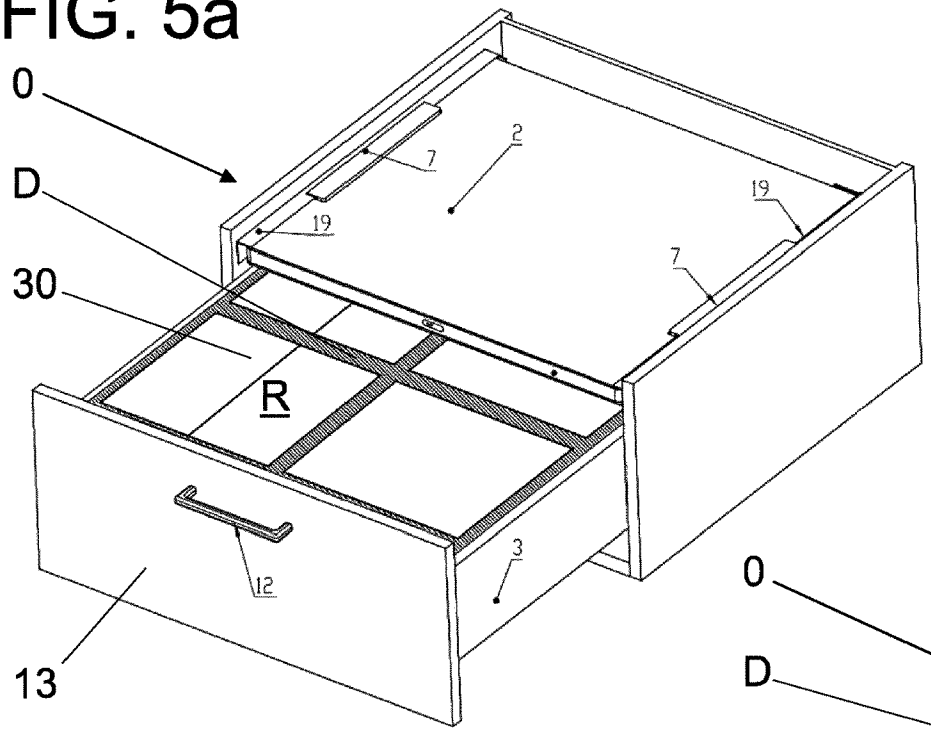
FIG. 5*a* is a perspective view of a vacuum drawer device with peripheral seal fittings and two seal fittings crossing each other.
Figure 5B:
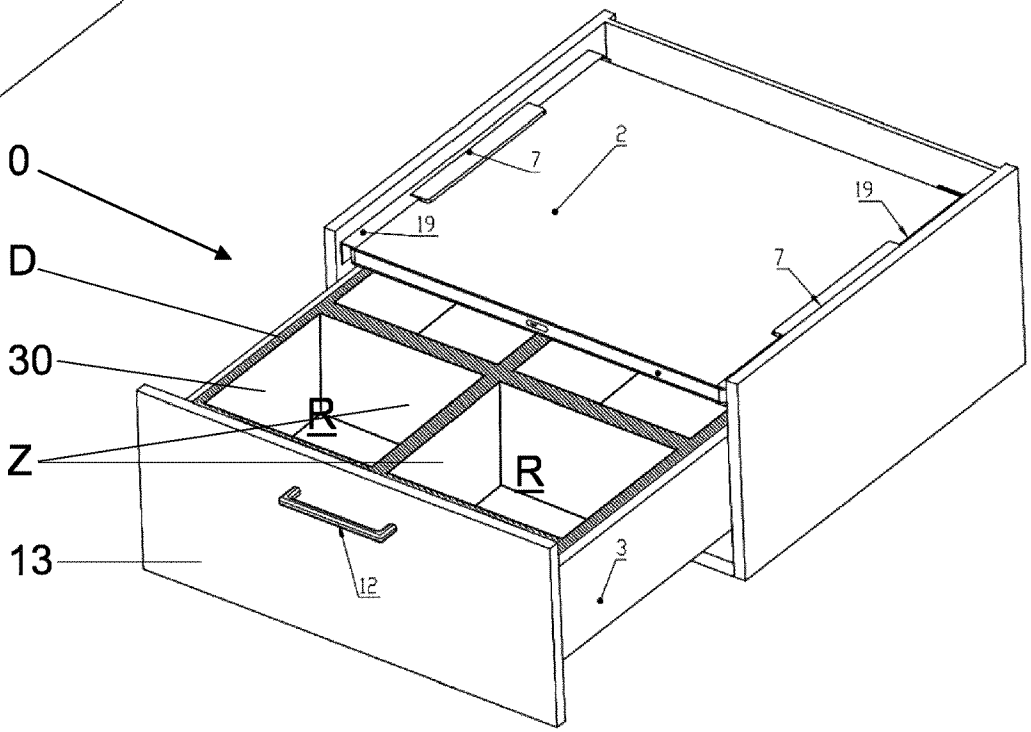
FIG. 5*b* is a perspective view of the vacuum drawer device according to FIG. 5*a*, wherein at the seal liftings partition walls are additionally included in the drawer interiors.

In order to increase the sealing effect further, several seal fittings D crossing each other, as shown in FIG. 5*a*, can be clamped between two opposing drawer walls 30 of the drawer 3. In addition to the seal fitting D positioned circumferentially along the inner periphery, a crossing is effected such that in total four storage sections for containers within the drawer 3 are separately defined.

In order to achieve several storage sections that can be closed airtight independently from each other, airtight separating walls between the seal fitting D and the bottom of the drawer 3 running through the drawer interior R can be arranged below the seal fittings D crossing each other. However, along the laterally extending seal fittings D, separating walls do not need to be arranged.

The laterally extending seal fittings D and also the seal fittings D crossing each other can be designed as airtight angles or U-profiles made of metal or plastic. The seal fittings D have to be designed in a sufficiently stable manner to be able to resist the back pressure of the cover 2 on the opening of the drawer interior R.

The construction of the cover 2 should have a sandwich structure. That way, the required stiffness of the cover 2 is ensured. The stiffness is required for the sealing. The cover layers are therefore frictionally connected to the core layer. This construction ensures a high stiffness having a low height and a low mass. The cover layers can be made of glass and the core layers of stiff, airtight foam material.

REFERENCE LIST

0 vacuum drawer device
1 pump/air pump
11' air channel/venting channel
2 cover
21' airtight membrane
22' foam layer
23' air inlet opening
24' sealing means
3 drawer
30 drawer wall
31' drawer extension
D seal fitting
Z separating wall
X drawer edge
R drawer interior
4 valve/solenoid valve
6 closed position sensor
7 lifting means/servo motor
71' servo disc
72' screw with a bearing bush
8 controller
9 drawer carcass
10 electric cable
11 control cable
12 handle
13 front panel
14 container
15 operating switch/on and off switch
16 pressure sensor
17 frame
18 proximity sensor
S sliding movement direction
H lifting direction
A recess

The invention claimed is:

1. A vacuum drawer device comprising:

a drawer movable linearly in a sliding movement direction, and the drawer having a drawer interior;

a cover designed in an airtight fashion to close the drawer interior of the drawer;

an electric lift configured to control a lifting movement of the cover in a lifting direction extending perpendicularly with respect to the sliding movement direction, wherein the cover has an air channel leading inside of the cover, the air channel being operatively connected to an electric evacuation device such that, when the cover is placed on the drawer, air is pumped out of the drawer interior via the air channel, wherein the vacuum drawer device further comprises a seal fitting arranged circumferentially along an entire inner periphery at drawer walls of the drawer on a cover side of the drawer, and the seal fitting extending clamped between two of the drawer walls of the drawer along a side facing the cover such that, in a closed position of the vacuum drawer device or, respectively, the drawer, the cover rests on the seal fitting to allow for an evacuation of the drawer interior.

2. The vacuum drawer device according to claim 1, wherein the seal fitting is a first seal fitting of at least two seal fittings crossing each other and clamped between two of the drawer walls, and more than two storage sections for containers in the drawer interior within the drawer can be separately defined.

3. The vacuum drawer device according to claim 1, wherein the seal fitting is configured to have an airtight sealing angle unmovably fixed at least at one side in the drawer interior at the drawer wall.

4. The vacuum drawer device according to claim 1, wherein the seal fitting is arranged to be flush with a drawer edge extending circumferentially at the drawer walls and between at least two adjacent drawer edges.

5. The vacuum drawer device according to claim 1, wherein the seal fitting is a first seal fitting of a plurality of seal fittings projecting from the drawer interior and arranged to be distanced from the drawer edge.

6. The vacuum drawer device according to claim 1, further comprising, below the seal fitting, an airtight separating wall between the seal fitting and a bottom of the drawer so as to extend along the drawer interior to form airtight drawer interior sections separated from each other.

7. The vacuum drawer device according to claim 6, wherein the air channel is one of a plurality of air channels in the cover each leading to a different drawer interior section to allow a different negative pressure to be achieved in different drawer interior sections.

* * * * *